US011094249B2

(12) United States Patent
Nakamura

(10) Patent No.: US 11,094,249 B2
(45) Date of Patent: Aug. 17, 2021

(54) DISPLAY DEVICE AND METHOD FOR DRIVING DISPLAY DEVICE

(71) Applicant: NICHIA CORPORATION, Anan (JP)

(72) Inventor: Shun Nakamura, Naruto (JP)

(73) Assignee: NICHIA CORPORATION, Anan (JP)

( * ) Notice: Subject to any disclaimer, the term of this patent is extended or adjusted under 35 U.S.C. 154(b) by 0 days.

(21) Appl. No.: 16/849,995

(22) Filed: Apr. 16, 2020

(65) Prior Publication Data

US 2020/0335031 A1 Oct. 22, 2020

(30) Foreign Application Priority Data

Apr. 18, 2019 (JP) ..... JP2019-079195

(51) Int. Cl.
*G09G 3/32* (2016.01)

(52) U.S. Cl.
CPC ..... *G09G 3/32* (2013.01); *G09G 2310/0202* (2013.01); *G09G 2310/0264* (2013.01); *G09G 2320/04* (2013.01)

(58) Field of Classification Search
CPC ..... G09G 3/32; G09G 3/3212; G09G 3/3216; G09G 2300/06; G09G 2310/0256; G09G 3/2014; G09G 2320/0209; G09G 2300/0426; G09G 2310/08; G09G 2320/0233; G09G 3/30; H03K 17/162; H03K 17/6871
See application file for complete search history.

(56) References Cited

U.S. PATENT DOCUMENTS

2005/0052141 A1* 3/2005 Thielemans ..... G09G 3/3216 315/169.3

FOREIGN PATENT DOCUMENTS

| | | |
|---|---|---|
| JP | 5793923 B2 | 11/2012 |
| JP | 6171585 B2 | 12/2014 |
| JP | 6413559 B2 | 5/2016 |

* cited by examiner

*Primary Examiner* — Sanjiv D. Patel
(74) *Attorney, Agent, or Firm* — Mori & Ward, LLP

(57) ABSTRACT

A display device includes a first light-emitting element connected to the first drive line and the first common line, a second light-emitting element connected to the first drive line and the second common line, and a sink driver connected to the first and second light-emitting elements via the first drive line. The sink driver is configured to alternatively take a selected state in which the sink driver pulls a current and an unselected state in which the sink driver does not pull a current. A second forward voltage of the second light-emitting element when voltage is supplied to the second common line and when the sink driver is in the unselected state is larger than a first forward voltage of the first light-emitting element when voltage is supplied to the first common line and when the sink driver is in the unselected state.

11 Claims, 12 Drawing Sheets

DISPLAY DEVICE AND METHOD FOR DRIVING DISPLAY DEVICE

CROSS-REFERENCE TO RELATED APPLICATION

This application claims priority to Japanese Paten Application No. 2019-079195, filed on Apr. 18, 2019, the disclosure of which is hereby incorporated by reference in its entirety.

FIELD

Embodiments described herein relate generally to a display device and a method for driving display device.

BACKGROUND

The disclosure relates to a display device and a method for driving a display device.

In recent years, narrow-pitch dot matrix units are being developed as LED (Light Emitting Diode) packages are downscaled. The required performance level naturally is higher when such units are located indoors to be viewed from close up because falsely-lit LEDs (unintended micro-lighting of unlit LEDs) are noticed more easily than conventionally. Also, conditions are such that false lighting occurs easily due to the increase of the parasitic capacitance of wiring as LED packages are downscaled and dot pitches become narrower (denser substrate wiring), the higher luminance of LEDs resulting in lighting with a visually-noticeable brightness even for micro currents, etc. See, e.g., Japanese Patent No. 6171585, Japanese Patent No. 5793923, and Japanese Patent No. 6413559.

SUMMARY

According to an aspect of the present invention, a display device includes a first common line; a second common line to which voltage is supplied after voltage is supplied to the first common line; a first drive line; a first light-emitting element including a first anode connected to the first drive line, and a first cathode connected to the first common line; and a second light-emitting element including a second anode connected to the first drive line, and a second cathode connected to the second common line; a sink driver connected to the first anode via the first drive line and connected to the second anode via the first drive line. The sink driver is configured to alternatively take a selected state in which the sink driver pulls a current and an unselected state in which the sink driver does not pull a current. A second forward voltage of the second light-emitting element when voltage is supplied to the second common line and when the sink driver is in the unselected state is larger than a first forward voltage of the first light-emitting element when voltage is supplied to the first common line and when the sink driver is in the unselected state.

According to another aspect of the present invention, a method for driving a display device includes providing a first light-emitting element including a first anode connected to a first drive line, and a first cathode connected to a first common line; providing a second light-emitting element including a second anode connected to the first drive line, and a second cathode connected to a second common line; providing a sink driver connected to the first anode via the first drive line and connected to the second anode via the first drive line, the sink driver being configured to alternatively take a selected state in which the sink driver pulls a current and an unselected state in which the sink driver does not pull a current; supplying voltage to a second common line; supplying voltage to a first common line after supplying the voltage to the second common line; and setting the sink driver in the unselected state and supplying voltage to the first and second common lines after supplying voltage to the second common line and before supplying voltage to the first common line. A second forward voltage of the second light-emitting element when voltage is supplied to the second common line and when the sink driver is in the unselected state is larger than a first forward voltage of the first light-emitting element when voltage is supplied to the first common line and when the sink driver is in the unselected state.

DETAILED DESCRIPTION OF EMBODIMENTS

Figure 1:
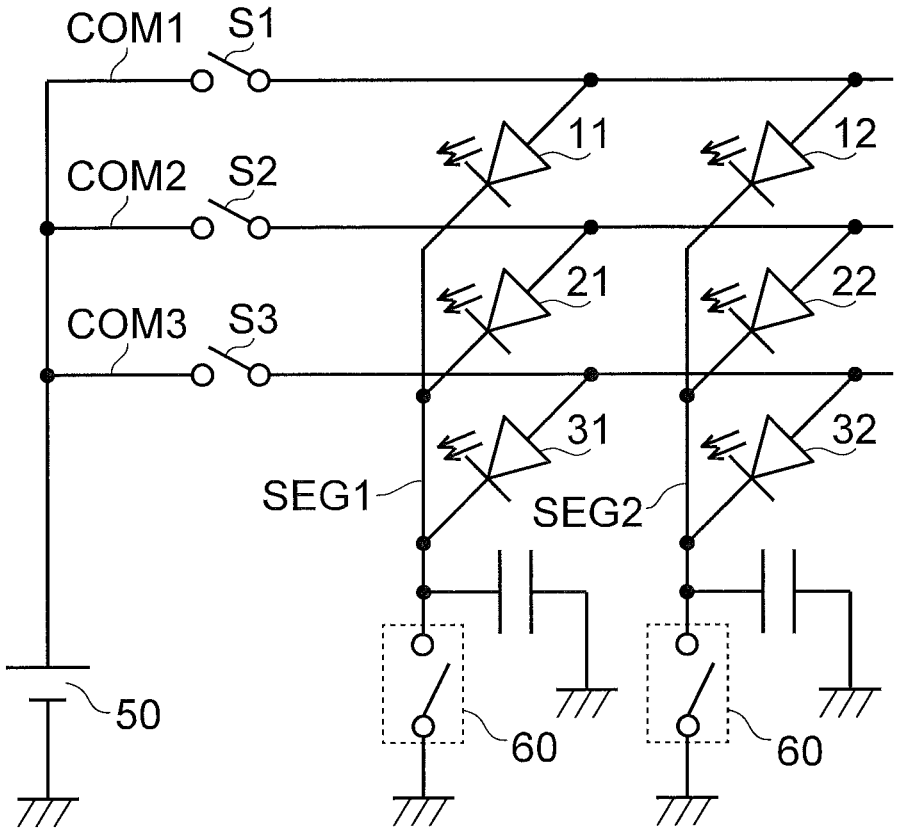
FIG. 1 is a schematic circuit diagram of a display device of an embodiment of the invention.

Embodiments will now be described with reference to the drawings. The same components in the drawings are marked with the same reference numerals.

FIG. 1 is a schematic circuit diagram of a display device of an embodiment of the invention.

The display device of the embodiment includes m common lines (m being a natural number of 2 or more), n drive lines (n being a natural number of 1 or more), and m×n light-emitting elements. For example, three common lines COM1, COM2, and COM3, two drive lines SEG1 and SEG2, and six light-emitting elements 11, 12, 21, 22, 31, and 32 are shown in FIG. 1. The light-emitting elements 11, 12, 21, 22, 31, and 32 are, for example, LEDs.

The common lines COM1, COM2, and COM3 are connected to a voltage source 50 and extend in a first direction (in FIG. 1, the lateral direction). A switch S1 is connected between the common line COM1 and the voltage source 50; a switch S2 is connected between the common line COM2 and the voltage source 50; and a switch S3 is connected between the common line COM3 and the voltage source 50.

The drive lines SEG1 and SEG2 extend in a second direction (in FIG. 1, the vertical direction) orthogonal to the first direction. The drive lines SEG1 and SEG2 are connected to sink drivers (or current sources) 60.

The light-emitting element 11 is connected to the common line COM1 and the drive line SEG1. The anode of the light-emitting element 11 is connected to the common line COM1; and the cathode of the light-emitting element 11 is connected to the drive line SEG1.

The light-emitting element 21 is connected to the common line COM2 and the drive line SEG1. The anode of the light-emitting element 21 is connected to the common line COM2; and the cathode of the light-emitting element 21 is connected to the drive line SEG1.

The light-emitting element 31 is connected to the common line COM3 and the drive line SEG1. The anode of the light-emitting element 31 is connected to the common line COM3; and the cathode of the light-emitting element 31 is connected to the drive line SEG1.

The light-emitting element 12 is connected to the common line COM1 and the drive line SEG2. The anode of the light-emitting element 12 is connected to the common line COM1; and the cathode of the light-emitting element 12 is connected to the drive line SEG2.

The light-emitting element 22 is connected to the common line COM2 and the drive line SEG2. The anode of the light-emitting element 22 is connected to the common line COM2; and the cathode of the light-emitting element 22 is connected to the drive line SEG2.

The light-emitting element 32 is connected to the common line COM3 and the drive line SEG2. The anode of the light-emitting element 32 is connected to the common line COM3; and the cathode of the light-emitting element 32 is connected to the drive line SEG2.

The multiple light-emitting elements that have the matrix arrangement include, for example, light-emitting elements emitting red light, light-emitting elements emitting green light, and light-emitting elements emitting blue light. For example, the light emission peak wavelengths of the multiple light-emitting elements 11, 21, and 31 connected to the same drive line SEG1 are substantially the same; and the light-emitting elements 11, 21, and 31 emit light of the same color. Similarly, the light emission peak wavelengths of the multiple light-emitting elements 12, 22, and 32 connected to the same drive line SEG2 are substantially the same; and the light-emitting elements 12, 22, and 32 emit light of the same color.

The light emission peak wavelengths of the light-emitting elements 11, 21, and 31 connected to the drive line (a first drive line) SEG1 are different from the light emission peak wavelengths of the light-emitting elements 12, 22, and 32 connected to the drive line (a second drive line) SEG2 next to the drive line SEG1 in the first direction. In other words, the light emission colors of the light-emitting elements 11, 21, and 31 connected to the drive line SEG1 are different from the light emission colors of the light-emitting elements 12, 22, and 32 connected to the drive line SEG2. For example, a light-emitting element that emits red light, a light-emitting element that emits green light, and a light-emitting element that emits blue light are arranged repeatedly along each of the common lines COM1, COM2, and COM3.

The display device of the embodiment is driven by a dynamic lighting control technique. The switches S1, S2, and S3 are switched ON sequentially; and a voltage Vcom is applied from the voltage source 50 sequentially to the common lines COM1, COM2, and COM3. For example, the switch S1 is switched ON, the switches S2 and S3 other than the switch S1 are switched OFF, and the voltage Vcom is applied to the common line COM1; then, the switch S2 is switched ON, the switches S1 and S3 other than the switch S2 are switched OFF, and the voltage Vcom is applied to the common line COM2; then, the switch S3 is switched ON, the switches S1 and S2 other than the switch S3 are switched OFF, and the voltage Vcom is applied to the common line COM3. The control of applying the voltage Vcom sequentially to the common lines COM1, COM2, and COM3 is repeated.

When the voltage Vcom is applied to the common line to which the light-emitting element to be lit is connected, by driving the sink driver 60 connected to the drive line (the selected drive line) to which the light-emitting element to be lit is connected, the current from the voltage source 50 flows through the common line, the light-emitting element, and the selected drive line and is pulled by the sink driver 60. The light-emitting element to be lit is lit thereby. The brightness of the lighting of the light-emitting element is adjusted by the magnitude of the current pulled by the sink driver 60 and/or the pulling time.

For example, the light-emitting element 11 is lit when the voltage Vcom is applied to the common line COM1 and the drive line SEG1 is selected by the sink driver 60. The light-emitting element 21 is not lit when the voltage Vcom is applied to the common line COM2 and the drive line SEG1 is in the unselected state (or the sink driver 60 is in the unselected state in which the sink driver 60 is not driven and the current is not pulled by the sink driver 60); and the light-emitting element 31 is not lit when the voltage Vcom is applied to the common line COM3 and the drive line SEG1 is in the unselected state.

Figure 8:
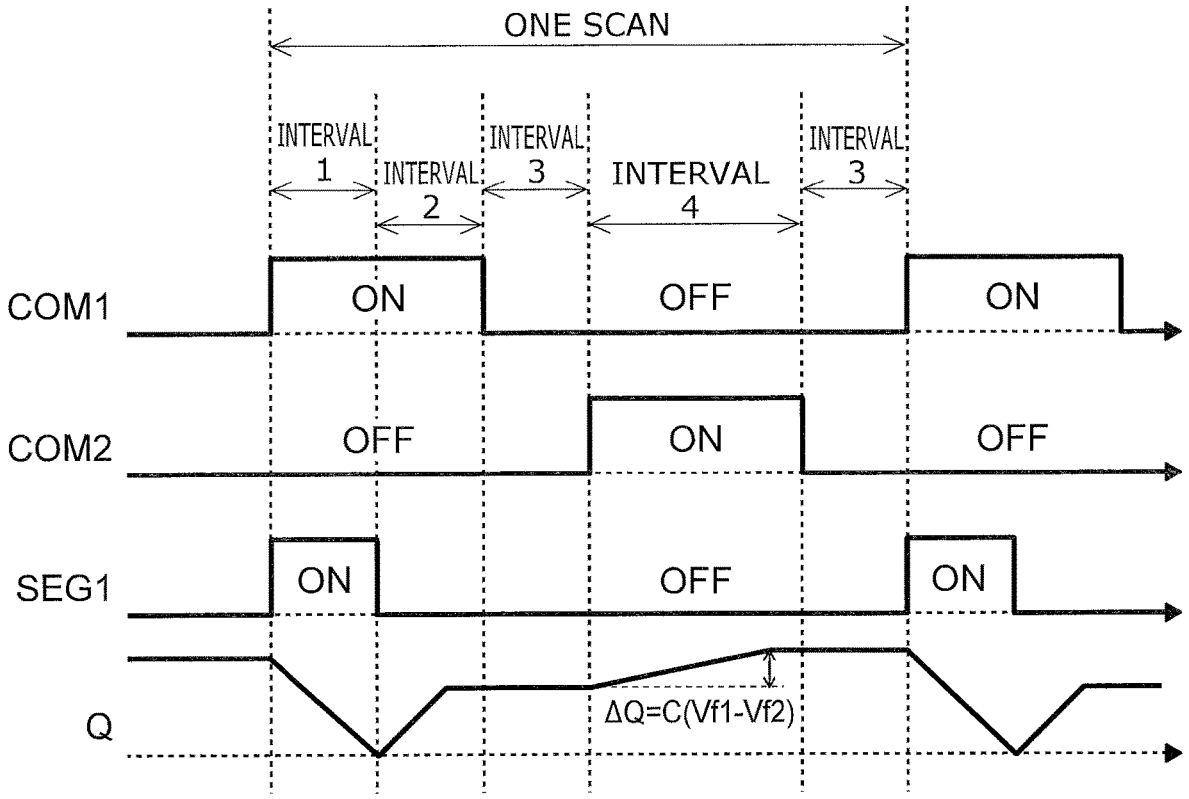
FIG. 8 is a timing chart showing a method for driving a display device of a comparative example.

Here, FIG. 8 is a timing chart showing a method for driving a display device of a comparative example. FIG. 8 is, for example, a timing chart of an operation for the light-emitting elements 11 and 21 connected to the same drive line SEG1 in which the light-emitting element 11 is lit but the light-emitting element 21 is not lit in one scan. One scan refers to the period of one cycle from the timing of the common line COM1 being switched ON until the next time the common line COM1 is switched ON after the periods in which the other common lines are switched ON.

In FIG. 8, the common lines COM1 and COM2 being ON respectively refers to the states in which the switches S1 and S2 are ON and the voltage Vcom from the voltage source 50 is applied respectively to the common lines COM1 and COM2. The common lines COM1 and COM2 being OFF respectively refers to the states in which the switches S1 and S2 are OFF and the voltage Vcom from the voltage source 50 is not applied to the common lines COM1 and COM2.

The drive line SEG1 being ON refers to the state in which the sink driver 60 is driven and the current is pulled by the sink driver 60 from the drive line SEG1 (the selected state of the drive line SEG1). The drive line SEG1 being OFF refers to the state in which the sink driver 60 is not driven and the current is not pulled by the sink driver 60 from the drive line SEG1 (the unselected state of the drive line SEG1).

An interval 1, an interval 2, an interval 3, an interval 4, and the interval 3 continue sequentially in one scan.

Figure 9:
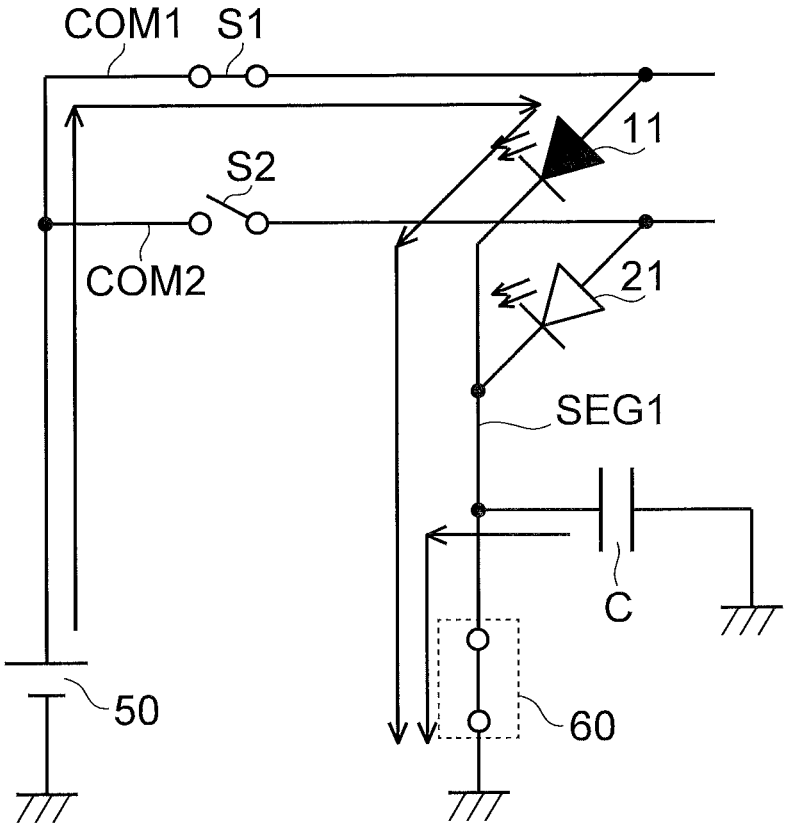
FIG. 9 is a schematic circuit diagram showing a state of an interval 1 of FIG. 8.

FIG. 9 is a schematic circuit diagram showing the state of the interval 1 of FIG. 8. The capacitance that occurs parasitically in the drive line SEG1 is illustrated as C in FIG. 9. The capacitance that occurs parasitically in the drive line SEG1 is illustrated as C in the other drawings described below as well. The flow of the current is illustrated by arrows in FIG. 3, FIG. 4, FIG. 6, FIG. 7, FIG. 9, FIG. 10, and FIG. 12.

First, in the interval 1, the common line COM1 is ON; the common line COM2 is OFF; and the drive line SEG1 is ON. In the interval 1 as shown in FIG. 9, the current flows from the voltage source 50 through the common line COM1, the light-emitting element 11, and the drive line SEG1, and is pulled by the sink driver 60; and the light-emitting element 11 is lit. The light-emitting element 21 is not lit because the common line COM2 is OFF.

At this time, a charge Q that is stored in the parasitic capacitance C is discharged via the sink driver 60; and the charge Q that was stored in the parasitic capacitance C becomes 0.

Figure 10:
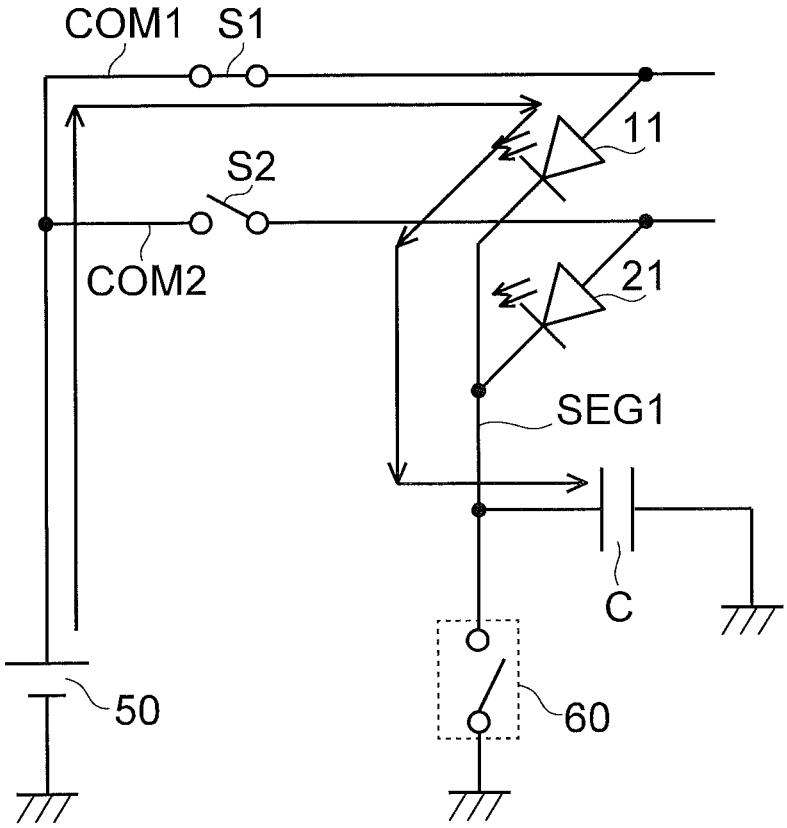
FIG. 10 is a schematic circuit diagram showing a state of an interval 2 of FIG. 8.

FIG. 10 is a schematic circuit diagram showing the state of the interval 2 of FIG. 8. In the interval 2, the common line COM1 is ON; the common line COM2 is OFF; and the drive line SEG1 is OFF. Because the drive line SEG1 is OFF, the current is not pulled by the sink driver 60; and the rated current does not flow in the light-emitting element 11. In other words, the light-emitting element 11 is not lit with a brightness corresponding to the rated current.

However, a micro current that is smaller than the rated current (a leakage current flowing toward the sink driver 60 in the non-driving state) charges the parasitic capacitance C from the common line COM1 via the light-emitting element 11. At this time, the charge Q that is charged in the parasitic capacitance C is $Q=C(Vcom-Vf1)$, wherein the voltage of the voltage source 50 is Vcom, and the forward voltage when the micro current recited above flows in the light-emitting element 11 is Vf1.

At this time, because the light-emitting element 11 is lit brightly by the rated current in the previous interval 1, a human does not sense the micro-lighting of the light-emitting element 11 in the interval 2 even though the light-emitting element 11 is lit with a micro brightness corresponding to the micro current.

Figure 11:
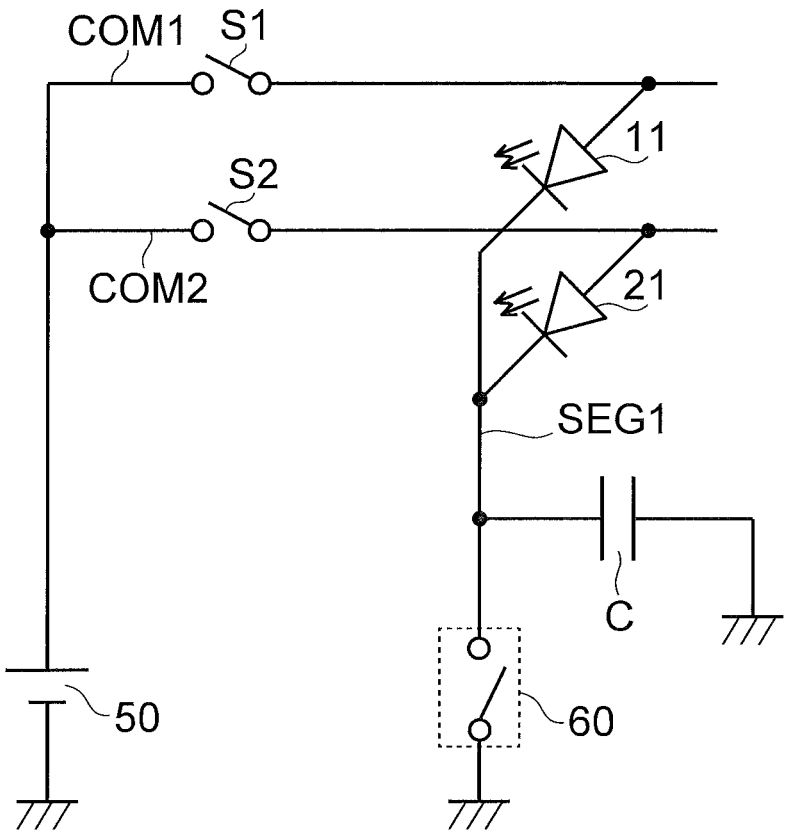
FIG. 11 is a schematic circuit diagram showing a state of an interval 3 of FIG. 8.

FIG. 11 is a schematic circuit diagram showing the state of the interval 3 of FIG. 8. In the interval 3, the common line COM1 is OFF; the common line COM2 is OFF; and the drive line SEG1 is OFF. The charge ($Q=C(Vcom-Vf1)$) that was charged in the parasitic capacitance C in the previous interval 2 is maintained. The light-emitting element 11 and the light-emitting element 21 are not lit.

Figure 12:
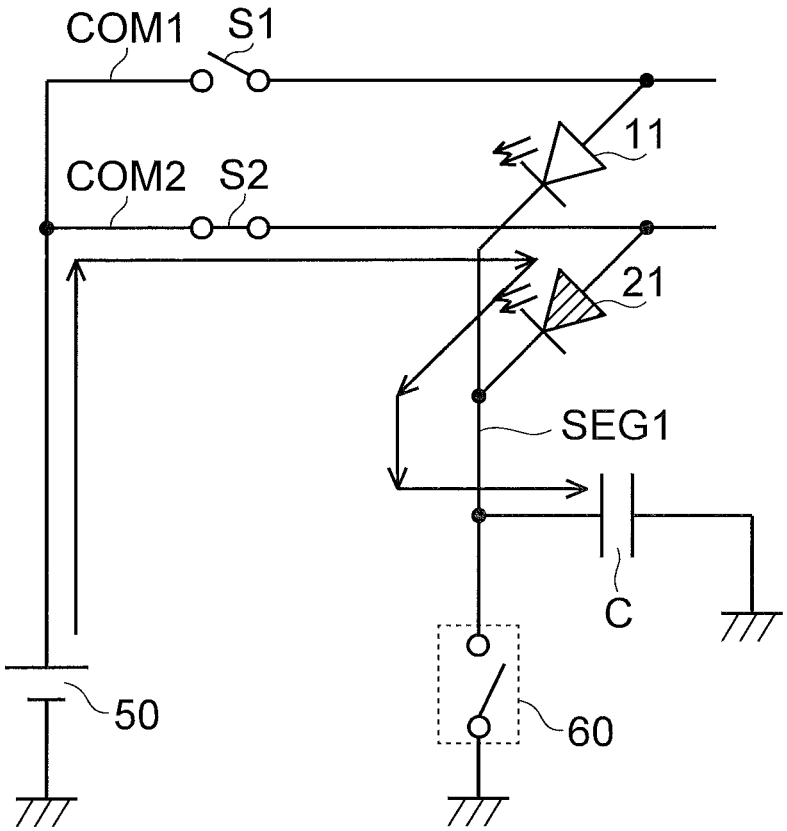
FIG. 12 is a schematic circuit diagram showing a state of an interval 4 of FIG. 8.

FIG. 12 is a schematic circuit diagram showing the state of the interval 4 of FIG. 8. In the comparative example, the forward voltage Vf1 of the light-emitting element 11 when the micro current recited above (e.g., about 10 μA) flows is larger than a forward voltage Vf2 of the light-emitting element 21 when the micro current recited above flows.

In the interval 4 of the comparative example, the common line COM1 is OFF; the common line COM2 is ON; and the drive line SEG1 is OFF. Because the common line COM2 is ON, a micro current charges the parasitic capacitance C from the common line COM2 via the light-emitting element 21.

At this time, $C(Vcom-Vf1)<C(Vcom-Vf2)$ because $Vf1>Vf2$. In other words, in the interval 4, because there is leeway for the charge to accumulate in the parasitic capacitance C, the parasitic capacitance C is charged via the light-emitting element 21. A charge $\Delta Q$ ($=C(Vf1-Vf2)$) which is the difference between the charge ($C(Vcom-Vf1)$) stored in the parasitic capacitance C in the interval 3 and the charge ($C(Vcom-Vf2)$) stored in the parasitic capacitance C in the interval 4 moves into the parasitic capacitance C via the light-emitting element 21 in the interval 4.

Accordingly, in the interval 4, even though the drive line SEG1 is unselected and the light-emitting element 21 is not to be lit, the light-emitting element 21 undesirably is lit, i.e., falsely-lit, with a micro brightness due to the micro current.

Conversely, in the embodiment, the false lighting of the light-emitting elements not to be lit can be suppressed by setting $Vf1<Vf2<Vf3$ for the scanning sequence of one cycle in which the common line COM2 is ON after the common line COM1 is ON, the common line COM3 is ON after the common line COM2 is ON, and the common line COM1 is ON after the common line COM3 is ON, wherein the forward voltage (a first forward voltage) of the light-emitting element 11 when the micro current recited above flows is Vf1, the forward voltage (a second forward voltage) of the light-emitting element 21 when the micro current recited above flows is Vf2, and the forward voltage (a third forward voltage) of the light-emitting element 31 when the micro current recited above flows is Vf3.

Figure 2:
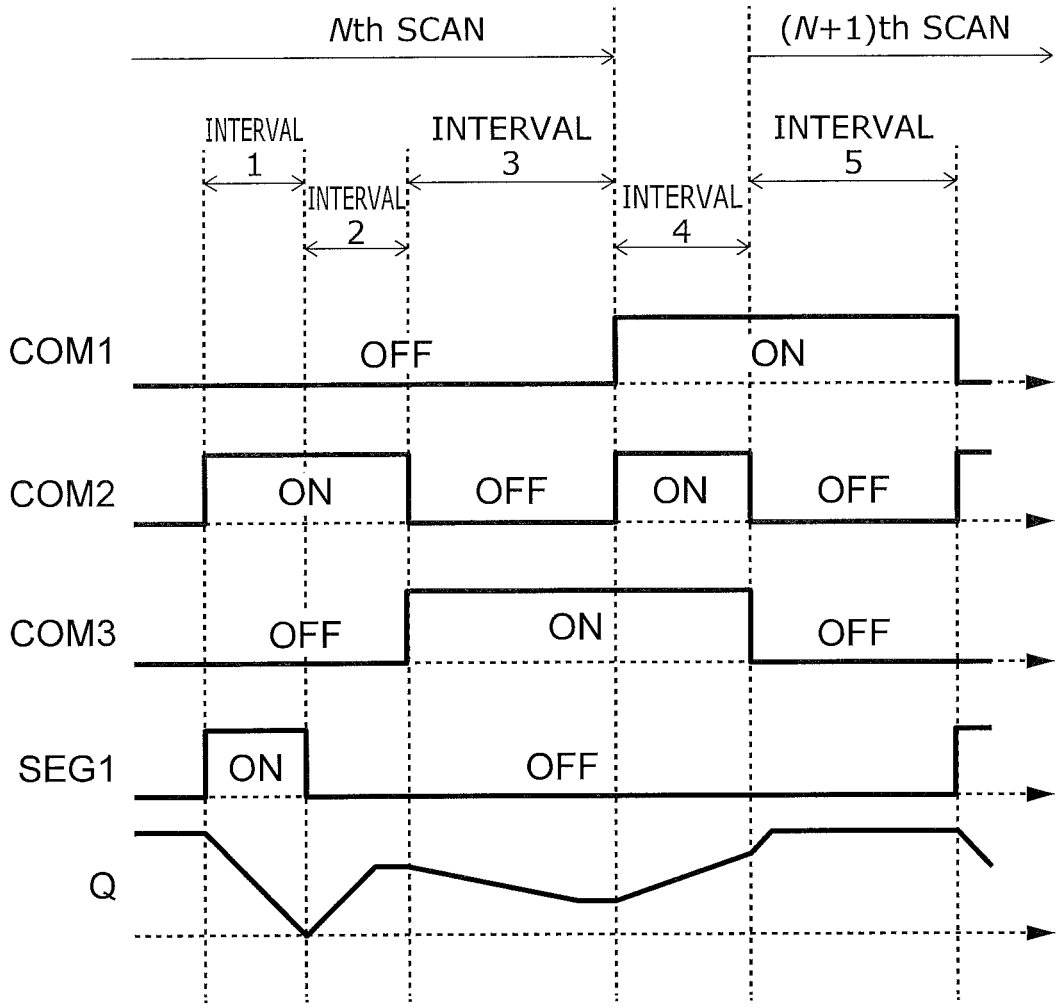
FIG. 2 is a timing chart showing a method for driving the display device of the embodiment of the invention.

FIG. 2 is a timing chart showing the method for driving the display device of the embodiment. For example, FIG. 2 illustrates the periods of a portion of a timing chart of an operation in which, for the light-emitting element (a first light-emitting element) 11, the light-emitting element (a second light-emitting element) 21, and the light-emitting element (a third light-emitting element) 31 connected to the same drive line (the first drive line) SEG1, the light-emitting element 21 is lit but the light-emitting elements 11 and 31 are not lit in the scanning period of the one cycle recited above for the common line (a first common line) COM1, the common line (a second common line) COM2, and the common line (a third common line) COM3. In one scan, the common line COM1, the common line COM2, and the common line COM3 are switched ON sequentially. The interval 4 is set between the previous scan (the Nth scan) and the next scan (the (N+1)th scan). FIG. 2 is an extracted illustration from the timing of the common line COM2 being switched ON in the Nth scan to the timing of the common line COM1 being switched OFF in the (N+1)th scan with the interval 4 interposed.

In FIG. 2, the common lines COM1, COM2, and COM3 being ON respectively refers to the states in which the switches S1, S2, and S3 are ON and the voltage Vcom from the voltage source 50 is applied respectively to the common lines COM1, COM2, and COM3. The common lines COM1, COM2, and COM3 being OFF respectively refers to the states in which the switches S1, S2, and S3 are OFF and the voltage Vcom from the voltage source 50 is not applied to the common lines COM1, COM2, and COM3.

The drive line SEG1 being ON refers to the state in which the sink driver 60 is driven and the current is pulled by the sink driver 60 from the drive line SEG1 (the selected state of the drive line SEG1 or the selected state of the sink driver 60). The drive line SEG1 being OFF refers to the state in which the sink driver 60 is not driven and the current is not pulled by the sink driver 60 from the drive line SEG1 (the unselected state of the drive line SEG1).

Figure 3:
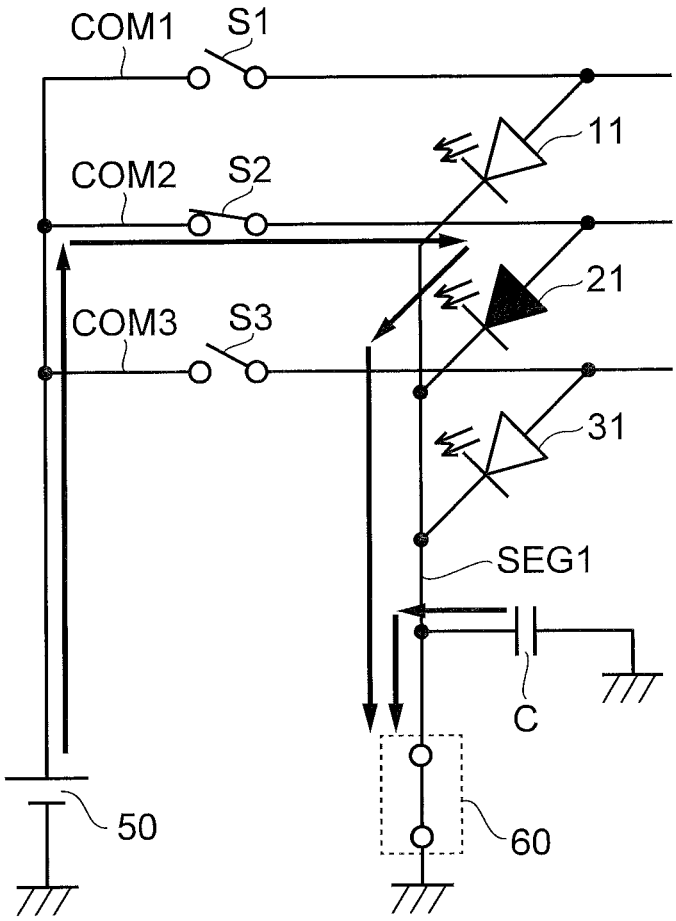
FIG. 3 is a schematic circuit diagram showing a state of an interval 1 of FIG. 2.

FIG. 3 is a schematic circuit diagram showing the state of the interval 1 of FIG. 2. In the interval 1, the common line COM2 is ON; the common lines COM1 and COM3 are OFF; and the drive line SEG1 is ON. In the interval 1, the current flows from the voltage source 50 through the common line COM2, the light-emitting element 21, and the drive line SEG1 and is pulled by the sink driver 60; and the light-emitting element 21 is lit. The light-emitting elements 11 and 31 are not lit because the common lines COM1 and COM3 are OFF.

At this time, the charge Q that is stored in the parasitic capacitance C is discharged via the sink driver 60; and the charge Q that was stored in the parasitic capacitance C becomes 0.

Figure 4:
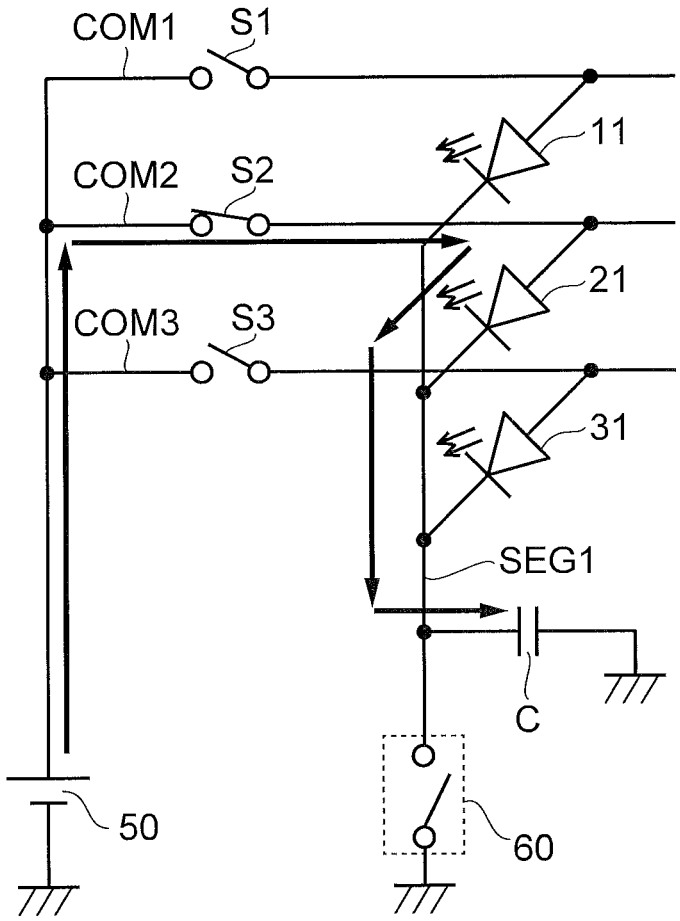
FIG. 4 is a schematic circuit diagram showing a state of an interval 2 of FIG. 2.

FIG. 4 is a schematic circuit diagram showing the state of the interval 2 of FIG. 2. In the interval 2, the common line COM2 is ON; the common lines COM1 and COM3 are OFF; and the drive line SEG1 is OFF. Because the drive line SEG1 is OFF, the current is not pulled by the sink driver 60; and the rated current does not flow in the light-emitting element 21. In other words, the light-emitting element 21 is not lit with a brightness corresponding to the rated current.

However, a micro current that is smaller than the rated current (a leakage current flowing toward the sink driver 60 in the non-driving state) charges the parasitic capacitance C from the common line COM2 via the light-emitting element 21. At this time, the charge Q that is charged in the parasitic capacitance C is Q=C(Vcom−Vf2), wherein the voltage of the voltage source 50 is Vcom, and the forward voltage when the micro current recited above flows in the light-emitting element 21 is Vf2.

At this time, because the light-emitting element 21 is lit brightly by the rated current in the previous interval 1, a human does not sense the micro-lighting of the light-emitting element 21 in the interval 2 even though the light-emitting element 21 is lit with a micro brightness corresponding to the micro current.

Figure 5:
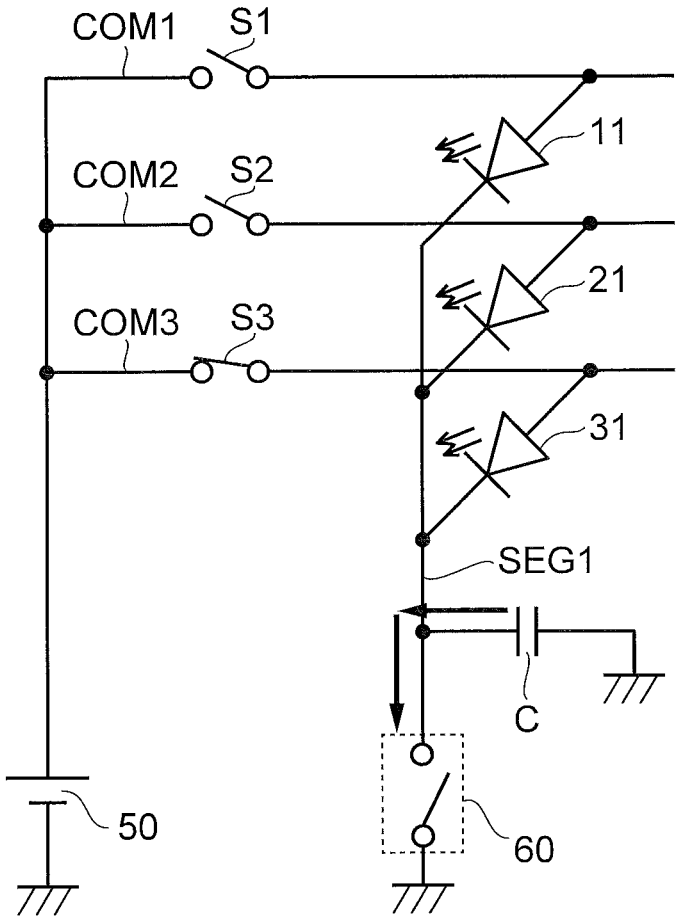
FIG. 5 is a schematic circuit diagram showing a state of an interval 3 of FIG. 2.

FIG. 5 is a schematic circuit diagram showing the state of the interval 3 of FIG. 2. In the interval 3, the common line COM3 is ON; the common lines COM1 and COM2 is OFF; and the drive line SEG1 is OFF.

In the embodiment, there is a relationship of Vf2<Vf3 between the forward voltage Vf2 when the micro current flows in the light-emitting element 21 when the voltage Vcom is supplied to the common line COM2 with the drive line SEG1 in the unselected state and a forward voltage Vf3 when the micro current flows in the light-emitting element 31 when the voltage Vcom is supplied to the common line COM3, which is ON after the common line COM2, with the drive line SEG1 in the unselected state.

Therefore, the relationship between the charge (C(Vcom−Vf2)) stored in the parasitic capacitance C when the micro current recited above flows in the light-emitting element 21 and the charge (C(Vcom−Vf3)) stored in the parasitic capacitance C when the micro current recited above flows in the light-emitting element 31 is C(Vcom−Vf2)>C(Vcom−Vf3).

Accordingly, the charge does not move into the parasitic capacitance C from the common line COM3 via the light-emitting element 31; and the charge that is the difference between C(Vcom−Vf2) and C(Vcom−Vf3) is discharged from the parasitic capacitance C to the sink driver 60. As a result, the false lighting of the light-emitting element 31 can be suppressed.

The common line COM1 is switched ON again after the common line COM3 is ON. Here, the false lighting of the light-emitting element 11 may occur because Vf3>Vf1.

Figure 6:
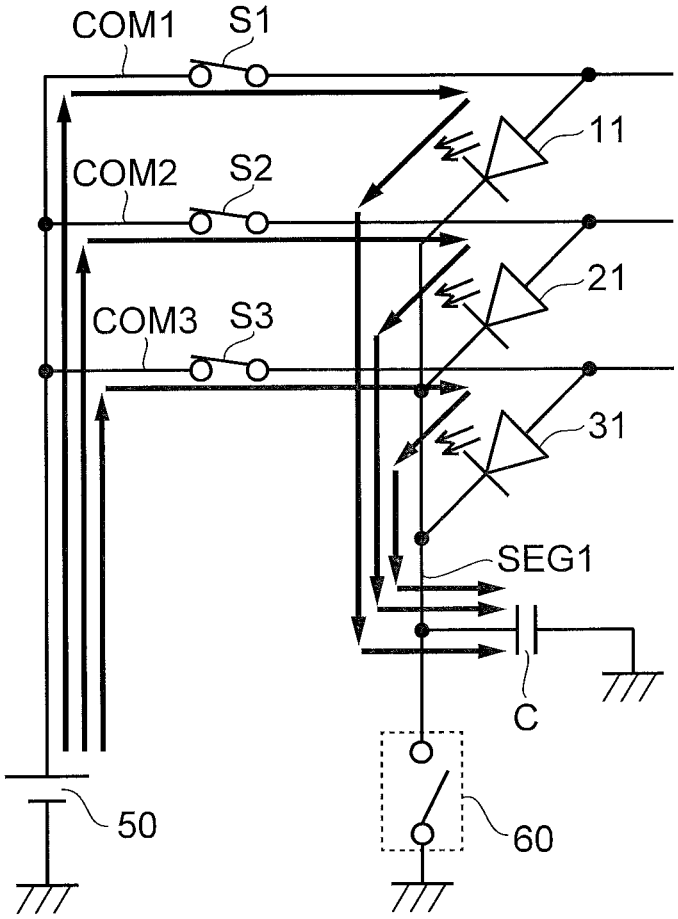
FIG. 6 is a schematic circuit diagram showing a state of an interval 4 of FIG. 2.

Therefore, the interval 4 is set in the embodiment. FIG. 6 is a schematic circuit diagram showing the state of the interval 4 of FIG. 2. In the interval 4, all of the common lines COM1, COM2, and COM3 to which the light-emitting elements 11, 21, and 31 are connected are switched ON. The drive line SEG1 is OFF.

After the Nth scan of the common lines COM1, COM2, and COM3 has ended and before the subsequent (N+1)th scan starts, the voltage Vcom from the voltage source 50 is supplied simultaneously or with an extremely short time difference to the common lines COM1, COM2, and COM3; and a charge is charged in the parasitic capacitance C on the drive line SEG1 via the light-emitting elements 11, 21, and 31. Because the micro current at this time flows by being distributed into three paths, the current that flows through each of the light-emitting elements 11, 21, and 31 is small; and the false lighting of the light-emitting elements 11, 21, and 31 in the interval 4 can be suppressed.

Figure 7:
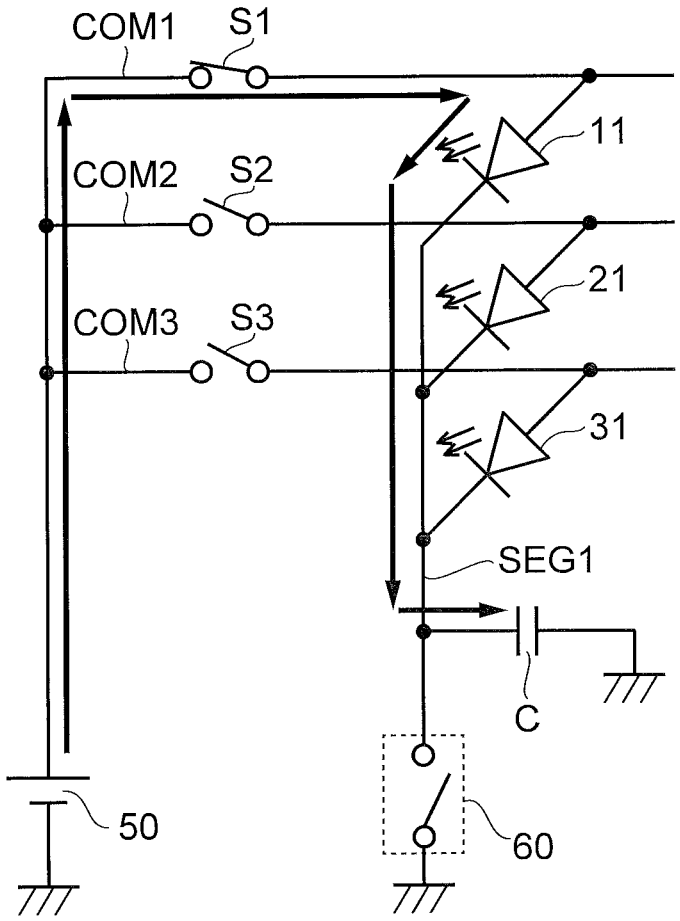
FIG. 7 is a schematic circuit diagram showing a state of an interval 5 of FIG. 2.

FIG. 7 is a schematic circuit diagram showing the state of an interval 5 of FIG. 2. In the interval 5, the common line COM1 is ON; the common lines COM2 and COM3 are OFF; and the drive line SEG1 is OFF.

Although a micro current charges the parasitic capacitance C from the common line COM1 via the light-emitting element 11 in the interval 5, instead of being the charging from a charge of 0 after discharging such as that of the interval 2, the charging is a trace amount from the charge amount charged in the previous interval 4; therefore, the current that flows through the light-emitting element 11 is ultra micro; and the false lighting of the light-emitting element 11 can be suppressed.

Although an example is described in the embodiments described above in which the light-emitting element 21 is lit and the light-emitting elements 11 and 31 are not lit among the light-emitting elements connected to the drive line SEG1 in the scanning period of the one cycle recited above for the common lines COM1, COM2, and COM3, in the case where m or more common lines are connected to the drive line SEG1, the false lighting of the unlit mth light-emitting element can be suppressed by setting $Vf_{m-1}<Vf_m$ for the relationship between the forward voltage $Vf_m$ when the micro current flows in the unlit mth light-emitting element connected to the mth common line and the forward voltage $Vf_{m-1}$ when the micro current flows in the (m−1)th light-emitting element connected to the (m−1)th common line which is to be lit and is ON once previous to the mth common line. The same can be said for any two adjacent light-emitting elements connected to the drive line SEG2.

The number of light-emitting elements connected to one drive line is not limited to three; and in the case where four or more light-emitting elements are connected to one drive line as well, the false lighting can be suppressed by providing the interval 4 shown in FIG. 2 and by setting the forward voltage for the micro current recited above to be larger for the light-emitting elements for which the common lines connected to the light-emitting elements are later in the sequence of being ON in one scan.

A substrate that includes the common lines and the drive lines is prepared; and the light-emitting elements are mounted on the substrate. According to the embodiments, the forward voltage for the micro current is measured for the multiple light-emitting elements before mounting the multiple light-emitting elements on the substrate.

After measuring, the multiple light-emitting elements are arranged on the substrate along the second direction which is the direction in which the drive line extends, are connected to the same drive line, and are connected to different common lines so that the measured value of the forward voltage is larger for the light-emitting elements connected to the common lines later in the sequence of being ON in one scan.

The embodiments of the present disclosure have been described with reference to specific examples. However, the present disclosure is not limited to these specific examples. Based on the above-described embodiments of the present disclosure, all embodiments that can be implemented with appropriately design modification by one skilled in the art are also within the scope of the present disclosure as long as the gist of the present disclosure is included. Besides, within the scope of the spirit of the present disclosure, one skilled in the art can conceive various modifications, and the modifications fall within the scope of the present disclosure.

What is claimed is:

1. A display device comprising:

a first common line;

a second common line to which voltage is supplied after voltage is supplied to the first common line;

a first drive line;

a first light-emitting element including a first anode connected to the first common line, and a first cathode connected to the first drive line;

a second light-emitting element including a second anode connected to the second common line, and a second cathode connected to the first drive line;

a sink driver connected to the first drive line, the sink driver being configured to alternatively take a selected state in which the sink driver pulls a current and an unselected state in which the sink driver does not pull a current; and a second forward voltage of the second light-emitting element when voltage is supplied to the second common line and when the sink driver is in the unselected state being larger than a first forward voltage of the first light-emitting element when voltage is supplied to the first common line and when the sink driver is in the unselected state.

2. The display device according to claim 1, further comprising:

a third common line to which voltage is supplied after voltage is supplied to the second common line; and a third light-emitting element including a third anode connected to the third common line and a third cathode connected to the first drive line, wherein a third forward voltage of the third light-emitting element when voltage is supplied to the third common line and when the sink driver is in the unselected state is larger than the second forward voltage.

3. The display device according to claim 1, further comprising:

a second drive line; and a light-emitting element including an anode connected to the first common line and a cathode connected to the second drive line, wherein light emission peak wavelengths of the first light-emitting element connected to the first drive line are different from a light emission peak wavelength of the light-emitting element connected to the second drive line.

4. The display device according to claim 1, wherein the first and the second common lines extend in a first direction, and wherein the first drive line extends in a second direction orthogonal to the first direction.

5. The display device according to claim 1, wherein a voltage is supplied to the first common line and the second common line, sequentially.

6. The display device according to claim 1, wherein the first forward voltage of the first light-emitting element is a first minimum voltage between the first anode and the first cathode at which current flows in the first light-emitting element, and wherein the second forward voltage of the second light-emitting element is a second minimum voltage between the second anode and the second cathode at which current flows in the second light-emitting element.

7. The display device according to claim 2, wherein the third forward voltage of the third light-emitting element is a third minimum voltage between the third anode and the third cathode at which current flows in the third light-emitting element.

8. A method for driving a display device, the method comprising:

providing a first light-emitting element including a first anode connected to a first common line, and a first cathode connected to a first drive line;

providing a second light-emitting element including a second anode connected to a second common line, and a second cathode connected to the first drive line;

providing a sink driver connected to the first drive line, the sink driver being configured to alternatively take a selected state in which the sink driver pulls a current and an unselected state in which the sink driver does not pull a current;

supplying voltage to the second common line;

supplying voltage to the first common line after supplying the voltage to the second common line; and setting the sink driver in the unselected state and supplying voltage to the first and second common lines after supplying voltage to the second common line and before supplying voltage to the first common line, wherein a second forward voltage of the second light-emitting element when voltage is supplied to the second common line and when the sink driver is in the unselected state is larger than a first forward voltage of the first light-emitting element when voltage is supplied to the first common line and when the sink driver is in the unselected state.

9. The method according to claim 8, further comprising:

providing a third light-emitting element including a third anode connected to a third common line, and a third cathode connected to the first drive line; and supplying voltage to the third common line after supplying voltage to the second common line, wherein a third forward voltage of the third light-emitting element when voltage is supplied to the third common line and when the sink driver is in the unselected state is larger than the second forward voltage.

10. The method according to claim 8, wherein the first forward voltage of the first light-emitting element is a first minimum voltage between the first anode and the first cathode at which current flows in the first light-emitting element, and wherein the second forward voltage of the second light-emitting element is a second minimum voltage between the second anode and the second cathode at which current flows in the second light-emitting element.

11. The method according to claim 9, wherein the third forward voltage of the third light-emitting element is a third minimum voltage between the third anode and the third cathode at which current flows in the third light-emitting element.

* * * * *